United States Patent [19]

Petkov et al.

[11] Patent Number: 4,619,129

[45] Date of Patent: Oct. 28, 1986

[54] METHOD OF AND APPARATUS FOR FORMING BLANKS BY HYDROPLASTIC DEFORMATION

[75] Inventors: Georgi K. Petkov; Todor S. Todorov; Yordanka R. Atanassova; Nikola M. Netzov; Stefan K. Deevski; Nikola I. Radev; Botyo P. Botev; Georgi M. Metev; Ivan H. Naydenov; Yakim N. Petrov, all of Gabrovo, Bulgaria

[73] Assignee: NPSP po Hydroplastichna Obrabotka na Metalite, Gabrobo, Bulgaria

[21] Appl. No.: 552,504

[22] Filed: Nov. 17, 1983

[30] Foreign Application Priority Data

Jan. 26, 1983 [BG] Bulgaria ..... 59472

[51] Int. Cl.[4] ..... B21D 26/02

[52] U.S. Cl. ..... 72/56; 29/421 E

[58] Field of Search ..... 27/421 E; 72/56, 61, 72/62

[56] References Cited

U.S. PATENT DOCUMENTS 4,049,367 9/1977 Tominaga ..... 72/56

4,147,459 11/1983 Tominota ..... 72/56

*Primary Examiner*—Leon Gilden

[57] ABSTRACT

Method of and apparatus for forming blanks by hydroplastic deformation. In a closed deformation space there is supplied a working fluid under high pressure and, simultaneously, the material of the blank to be deformed which is disposed in the deformation space is subjected to plastic deformation by the working fluid. In the zone of the closed deformation space there is applied a concentrated and controllable impulsed fluid load, this load being applied cyclically at equal time intervals and being controlled along the length of the blank being deformed.

The apparatus of the invention comprises a working tool with a blind central hole and radial channels connected thereto, and a female die in which the blank to be deformed is disposed. The working tool is connected to a supply cylinder in which there is provided a pressure chamber, the pressure chamber containing a piston connected to the working tool. The supply cylinder is fastened to the movable part of a press. The pressure chamber is connected to an impulse activator by means of a plunger which is attached tightly to the supply cylinder.

4 Claims, 2 Drawing Figures

METHOD OF AND APPARATUS FOR FORMING BLANKS BY HYDROPLASTIC DEFORMATION

Figure 1:
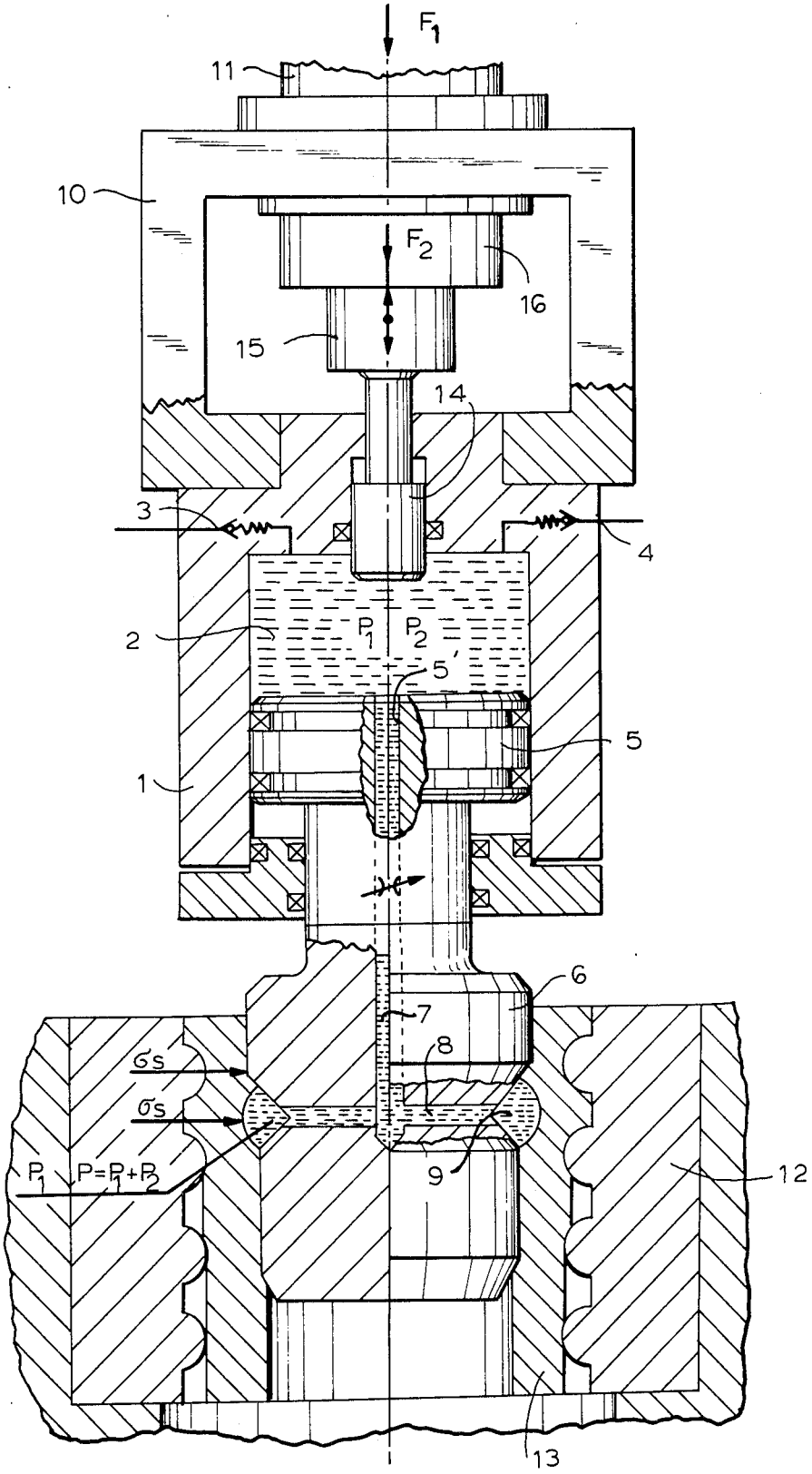

This invention relates to a method of and an apparatus for forming blanks by hydroplastic deformation; the resulting products can be used in metallurgy and in engineering in general.

In a known method for the impulse forming of blanks, such as metal blanks, disclosed in Japanese patent No. 53-27233, a high pressure impulse is produced in a working fluid enclosed in a deformation space, such high pressure impulse acting on the blank and affecting its plastic deformation.

A drawback of this method lies in the fact that it is applicable only for the deformation of thin-walled blanks, since the plastic deformation of the blanks is effected by the action of a pressure produced by scattered impulses. Furthermore, it is not possible to produce the necessary high pressure of the working fluid which can insure the total deformation of the blank after the action of one high pressure impulse thereon. Another drawback lies in the fact that the applied impulse is not self-supplied, and that it is necessary additionally to introduce a great quantity of working fluid, or continuously to increase the stroke of the apparatus which produces the impulse. This leads to a great consumption of working fluid or energy, and entails the use of a complicated apparatus for carrying out such method.

In aother method for forming blanks by hydroplastic formation, disclosed in Bulgarian patent No. 23783, a working fluid under high pressure is supplied to a closed deformation space and, simultaneously, the material in the blank in the deformation space is subjected to plastic deformation.

The apparatus for carrying out the prior art method referred to immediately above comprises a working tool with a blind central hole and radial channels connected to the blind central hole for effecting the forced lubrication of the formed surface and the working tool. The blak to be deformed is inserted in a female die with a internally profiled surface, and both the blank and the female die are mounted on a movable support. The working tool is movably connected to and sealed to the piston of a vertical supply cylinder, and such piston is provided with a central channel. Such central channel is connected to a pressure chamber which is formed in the vertical supply cylinder. The pressure chamber is connected by means of channels to a system for the supply of working fluid, such latter channels being machined in a housing to which the vertical supply cylinder is attached. This housing is attached to a press which provides for the movement of the vertical supply cylinder and the working tool.

A drawback of the prior art method and apparatus described immediately above lies in the fact that they cannot produce a high pressure of the working fluid which exceeds the yield strength of the material of the blank to be deformed. The production of such a pressure is limited by the area of the pressure chamber and the capacity of the piston to sustain higher pressures. In order to produce high pressures of the working fluid, it is necessary to reduce the area of the loaded section of the piston; it is not possible to achieve this for technical reasons and for the limits of the strength of materials employed in the apparatus. All this leads to the production of compressive stresses which are much lower than the yield strength of the material of the blank to be deformed, while to effect a hydroplastic deformation of the blank it is necessary to provide a great compressive force.

It is, therefore, a general object of the present invention to provide a method of and an apparatus for forming blanks by hydrodynamic deformation which can insure the production of a high pressure of the working fluid, exceeding the yield strength of the material of the blank to be deformed, without limitations as to the design sizes of the pressure chamber-piston pair, thus increasing the degree of deformation of the blank by the direct action of the working fluid under a reduced pressing force.

In accordance with the invention, this object is achieved by a method wherein in a closed deformation space there is provided a working fluid under high pressure and, simultaneously, the material of the blank in this space is subjected to plastic deformation. In accordance with the invention, there is applied a concentrated and controllable impulse fluid load in the zone of the closed deformation space. The concentrated impulse fluid load is applied cyclically at equal time intervals, and is controlled transferably along the length of the formed blank.

The above object of the invention is achieved by an apparatus which comprises a working tool with a blind central hole and with radial channels connected thereto, and a female die in which the blank is disposed. The working tool is connected to a supply cylinder in which there is provided a pressure chamber containing a piston connected to the working tool. The supply cylinder is fastened to the movable part of a press. According to the invention, the pressure chamber is connected to an impulse activator by means of a plunger which is attached to and sealed to the supply cylinder.

In another embodiment of the invention, the impulse activator is directly connected to the working tool in which the pressure chamber is disposed. In the piston of the supply cylinder there are fastened the impulse activator and the plunger. The radial channels of the working tool are provided with a throttling means.

The advantages of the method and apparatus of the invention lie in that, as the result of the dynamic impulse thrusting the working fluid out from the supply cylinder in which the working fluid is subjected to a previously produced high pressure, there is achieved a pressure which is several times higher than that previously produced and which is higher than the yield strength of the material being deformed. As a result, there is achieved a more effective flow of the material in radial and axial directions with reduced magnitudes of the pressing force. Since the applied impulse is directed and concentrated, and there is a possibility for its transferable control along the length of the blank being deformed, there is also provided the possibility for hydraulic forging, thus increasing the degree of hydroplastic deformation. All this results in an increase of the productivity of the process, and insures the production of high quality deformed products.

For a better understanding of the invention, reference should be made to the accompanying drawings in which there are illustrated and described preferred embodiments of the invention.

Figure 2:
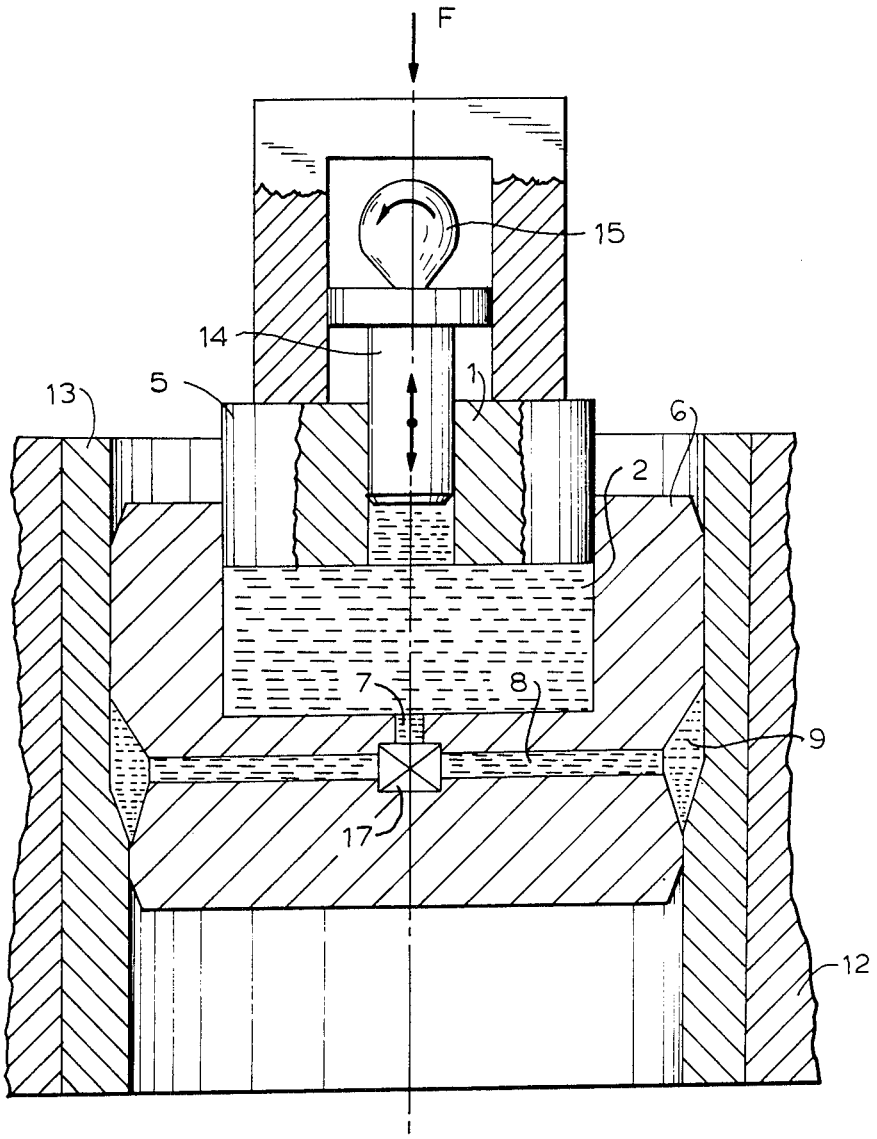

In the drawings:

FIG. 1 is a schematic longitudinal cross-sectional view of a first preferred embodiment of the apparatus of the invention; and FIG. 2 is a schematic longitudinal cross-sectional view of a second preferred embodiment of the apparatus of the invention.

Turning first to FIG 1, the apparatus there shown comprises a supply cylinder 1, in which there is provided a pressure chamber 2 and a channel 4 for the supply of the working fluid to the pressure chamber. Inside the supply cylinder 1 there is disposed a piston 5 with a throttled central passage 5' therein. To the piston 5 there is sealed a working tool 6 which is provided with a blind central passage 7 connected to the passage 5', the tool having radial channels 8 therein connected to the channel 7 for supplying lubricating fluid between the working tool and the blank 13 which the tool is to deform. The radical channels 8 are connected at their outer ends to the spaces 9 between the teeth of the working tool 6. The supply cylinder 1 is rigidly attached by means of attaching means 10 to the movable part 11 of a press. Coaxially of the working tool 6, inside the female die 12 which in the embodiment shown is provided with a profiled internal surface, there is disposed the blank 13 to be deformed. The front end of the working tool 6 is positioned in the blank 13, and the spaces 9 between the teeth of the working tool and the blank 13 form closed deformation spaces. Inside the supply cylinder 1 there is mounted and sealed a reciprocating plunger 14 by means of which the pressure chamber 2 is connected to an impulse activator 15, activator 15 being attached to a driving mechanism 16.

The above-described apparatus of FIG. 1 operates as follows: The blank 13, which is made of a malleable metal, is disposed in the female die 12 which in turn is disposed coaxially of the working tool 6. Working fluid is introduced into the system through the channel 4. The working fluid fills the pressure chamber 2, and the piston 5 moves downwardly toward its lower terminal position. The supply cylinder 1 is vented through a channel 3, and then the press plunger 11 moves downwardly; the piston 5 also moves downwardly until it is pressed tightly against the working tool 6. In this position, the spaces 9 between the teeth of the working tool 6 are filled with working fluid which passes through the blind central hole 7 and the radial channels 8 of the working tool.

Simultaneously, under the action of the downwardly directed pressing force $F_1$, the working tool 6 sinks down into the blank 13, plastically deforming its upper end. After the tight closing of the spaces 9 between the teeth of the working tool 6 by the blank 13, there is produced a high pressure $P_1$ inside the pressure chamber 2, such high pressure being proportional to the deforming, pressing force $F_1$. Immediately after that, the driving device 16 of the impulse activator 15 is actuated, and by means of the plunger 14 in the pressure chamber 2 there is produced an additional superposed impulsed pressure $P_2$. At this moment, the total pressure in the spaces 9 between the teeth of the working tool 6 is equal to the sum of these two pressures, that is, $P_1+P_2$.

If $\sigma_s$ is the yield strength of the material of the blank 13 in the zones where the female die 12 is in contact with the blank, and $\sigma'_s$ is the yield strength in the zones where is a cavity beneath the blank 13, then $\sigma'_s$ is less than $\sigma_s$ because of the work prehardening of the blank and the presence of torques above the cavities. As a result of this impulse action of the pressure on the surface and the plastic deformation of the blank in the zone of contact with active lubricating fluid, the metal being deformed will fill up the cavities between the teeth of the working tool and the deformed metal. By an appropriate selection of the diameters and lengths of the different steps of the working tool 6 and of the velocity of the press plunger 11 in the downward direction, it is possible to regulate the velocity of motion of the working tool 6, and by regulating the frequency and force of action $F_2$ on the plunger 15, it is possible to regulate the additional impulse degree of deformation produced by the apparatus. Depending upon the character of the formed profile (or alternatively, the character of the smooth inner surface of the deformed blank) the transferable impulse action of the working fluid is directed along the length of the formed blank 13 by means of the velocity of motion of the working tool 6. As a result, it is possible to apply in given zones of the blank the necessary number of impulses per time unit, whereby the action resembles hydraulic forging.

In the second embodiment of the apparatus, shown in FIG. 2, parts which are similar to those shown in FIG. 1 are designated by the same reference characters. In FIG. 2 the pressure chamber 2 is provided in the working tool 6. The impulse activator 15 and the plunger 14 are mounted in the piston 5 of the supply cylinder 1. Furthermore, the radial channels 8 of the working tool 6 are provided with a throttling component 17.

The embodiment of the invention illustrated in FIG. 2 operates as follows: In the female die 12 there is disposed the blank 13; the working tool being disposed within the blank. The pressure chamber 2 in the working tool is filled with working fluid and is vented. A downwardly directed force F is applied on the piston 5, and as a result the working tool 6 sinks into the blank 13, while the spaces 9 between the teeth are closed by the internal surface of the blank 13 being deformed. The thus formed space is filled with working fluid which passes through the throttling valve 17. After the working tool 6 has been inserted into the blank 13 sufficiently to form closed spaces 9 between the blank and the working tool 6, the throttling component means 17 is fully opened and the impulse activator 15 is switched on. A high pressure has been previously provided in the pressure chamber 2. Such high pressure is increased under the action of the impulse activator 15 by reason of the pumping-in of additional portions of working fluid at high pressure into the pressure chamber 2. Such high pressure fluid passes through the throttling component means 17 into the spaces 9 between the teeth on the working tool and the blank, whereby to effect a hydroplastic deformation of the blank.

It is to be understood that the aforesaid two illustrated and described embodiments of the method and apparatus of the invention are merely illustrative, and do not exhaust all possible variations of the method and apparatus of the invention. It is possible to carry out a simultaneous hydroplastic forming of the internal and external surfaces of a blank such as 13 by producing an additional impulse loading of the working fluid. The working tool necessary to effect such forming of the external surface may be shaped analogously to the above-described tool 6 for forming the internal surface of the blank.

Although the invention is described and illustrated when reference to a plurality of embodiments thereof, it is to be expressly understood that it is in no way limited to the disclosure of such preferred embodiments but is capable of numerous modifications within the scope of the appended claims.

We claim:

1. A method of deforming blanks by hydroplastic deformation, comprising supplying a working fluid under periodically varying high, material deforming pressure as a concentrated fluid load to a closed deformation space, said deformation space being partially bounded by a part of the surface of the blank which is momentarily to be deformed, and progressively varying the location of the part of the surface of the blank which is to be deformed until all of said surface of the blank has been subjected to hydroplastic deformation.

2. A method according to claim 1, wherein the working fluid is progressively applied to parts of the surface of the blank which is to be deformed cyclically and at equal time intervals.

3. A method according to claim 1, wherein the concentrated impulse fluid load imposed upon said part of the surface of the blank which is to be deformed is subjected is controlled transferably in incemente along the length of the blank being deformed.

4. A method according to claim 2, wherein the concentrated impulse fluid load imposed upon said part of the surface of the blank which is to be deformed is subjected to controlled transferably in incements along the length of the blank being deformed.

* * * * *